US010106392B2

(12) United States Patent
Peirsman et al.

(10) Patent No.: US 10,106,392 B2
(45) Date of Patent: Oct. 23, 2018

(54) BEVERAGE DISPENSER AND METHOD FOR MIXING ONE OR MORE BEVERAGE COMPONENTS WITH AT LEAST ONE CARBONATED LIQUID

(71) Applicant: Anheuser-Busch InBev S.A., Brussels (BE)

(72) Inventors: Daniel Peirsman, Leuven (BE); Stijn Vandekerckhove, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 15 days.

(21) Appl. No.: 15/108,313

(22) PCT Filed: Dec. 19, 2014

(86) PCT No.: PCT/EP2014/078714

§ 371 (c)(1),
(2) Date: Jun. 26, 2016

(87) PCT Pub. No.: WO2015/097083

PCT Pub. Date: Jul. 2, 2015

(65) Prior Publication Data

US 2016/0318746 A1 Nov. 3, 2016

(30) Foreign Application Priority Data

Dec. 27, 2013 (EP) ..... 13199695

(51) Int. Cl.

| | |
|---|---|
| ***B01F 5/02*** | (2006.01) |
| ***B67D 1/00*** | (2006.01) |
| ***B01F 3/04*** | (2006.01) |
| ***B01F 3/08*** | (2006.01) |

(52) U.S. Cl.

CPC ..... *B67D 1/005* (2013.01); *B01F 3/04446* (2013.01); *B01F 3/0807* (2013.01); *B01F 5/0256* (2013.01); *B67D 1/0016* (2013.01); *B67D 1/0021* (2013.01); *B01F 2215/0022* (2013.01)

(58) Field of Classification Search

USPC ..... 366/137.1

See application file for complete search history.

(56) References Cited

U.S. PATENT DOCUMENTS

| | | | |
|---|---|---|---|
| 2,905,448 | A | 9/1959 | Martinek |
| 2006/0237479 | A1 | 10/2006 | Fox |
| 2007/0140046 | A1 | 6/2007 | Serafin et al. |

FOREIGN PATENT DOCUMENTS

| | | |
|---|---|---|
| DE | 3709155 | 10/1987 |
| GB | 2091688 | 8/1982 |
| GB | 2135898 | 9/1984 |
| WO | WO 02/26614 | 4/2002 |

*Primary Examiner* — Mark Halpern

(74) *Attorney, Agent, or Firm* — Levy & Grandinetti

(57) ABSTRACT

A beverage dispenser and method for mixing one or more beverage components with at least one carbonated liquid is disclosed. The beverage container has at least one dispenser beverage inlet connected or connectable to a source of a beverage component. The beverage container has at least one dispenser carbonated liquid inlet connected or connectable to a source of a carbonated liquid. A mixing device for mixing one or more beverage components with at least one carbonated liquid into a final beverage is provided. The beverage container has a dispenser outlet for dispensing the final beverage. The mixing device has one or more double jet mixers.

19 Claims, 4 Drawing Sheets

BEVERAGE DISPENSER AND METHOD FOR MIXING ONE OR MORE BEVERAGE COMPONENTS WITH AT LEAST ONE CARBONATED LIQUID

This application is a 371 of PCT/EP2014/078714 filed 19 Dec. 2014

The present invention relates in first instance to a beverage dispenser.

In particular, the present invention relates to a beverage dispenser which allows the mixing of one or more beverage components and at least one carbonated liquid into a final beverage.

Without limiting the invention to the following examples, the beverage dispenser can for example be of a type wherein beverage components and a carbonated liquid are mixed with one another in a fixed ratio, or wherein for example the final beverage can be composed depending on a choice made by a user by means of an interface or the like.

A lot of beverage dispensers are known according to the state of the art for dispensing beverages, such as for example coffee, tea or any soft drink and so on.

In these known dispensers there is sometimes also a mixing of certain liquid beverage components with one another, such as for example water and milk or cream, as well as a mixing of the liquid beverage components with certain additives, typically powdered or granular additives, such as for example coffee powder, sugar, all kinds of flavours and so on.

For mixing different beverage components and additives the known beverage dispensers of the mentioned type are often not equipped at all with mixing means, the mixing being simply obtained by the flow of liquid beverage components into a container or receptacle under gravity or under pressure obtained from a certain liquid line or liquid vessel.

In some other known beverage dispensers mixing means are used for increasing the quality of the mixture to be obtained and more in particular for increasing its uniformity.

The mixing means are mostly of an electro-mechanical type, such as a blade or propeller provided in a receptacle, which is driven and rotated by an electric motor and which is intended for stirring or agitating the mixture of beverage components and additives provided in the receptacle.

It is sure that these known beverage dispensers do their job quite well in the applications for which they have been designed.

Nevertheless, for a new type of applications of supplying beverages, which are nowadays not yet common practice, but for which there is a lot of commercial potential according to marketing studies, the known beverage dispensers are not suitable.

Such a new type of application is for example the mixing of a liquid beverage component, such as a certain beer or beer concentrate with for example one or more of the following:

one or more other beers or beer concentrates;
a fruit juice or concentrate;
a vegetable juice or concentrate;
a syrup;
carbonated water;
a carbonated soft drink;
a strong alcohol;
a coffee;
a tea;
a plant extract;
and so on.

It is clear that a beverage component such as for example a beer or beer concentrate must be treated with a lot of care in general and certainly during mixing and/or after mixing with other beverage components and/or with a carbonated liquid.

Indeed, stirring or agitating a mixture comprising a beer or beer concentrate in an open receptacle which is exposed to the air risks to cause a change of the taste of the beer for all kinds of reasons, and it can result in a non-desired premature foaming of the beer at the surface as well.

Furthermore, it is known that for beer consumers the beer head is a very important aspect of the beer when it is served, determining its aesthetic look, its aroma and taste, as well as the feeling it causes in the mouth when consumed.

From a chemical point of view is beer foam a product composed of multiple polypeptides having each a different hydrophobicity, which hydrophobicity determines the stability of the beer foam.

Also the content of carbon dioxide and/or nitrogen in a beer is an important parameter that influences the foam formation.

The content of carbon dioxide and/or nitrogen in a mixture obtained from fore-mentioned beverage components, carbonated liquids and/or diluents, comprising a beer or beer concentrate, is usually drastically modified compared to the content of carbon dioxide and/or nitrogen in the separate original beverage components.

As a consequence, also the foaming capacity of the mixture is completely different from the foaming capacity of the original beverage components.

Dependent on the particular case, this foaming capacity is decreased or increased.

In order to obtain the desired beer head, in some cases the foaming of the mixed beverage components and the carbonated liquid needs to be limited, while in other cases this foaming should be stimulated on the other hand.

Known beverage dispensers do not possess suitable mixing means by which the foaming can be controlled.

One also understands that a high quality final beverage can only be obtained by mixing beverage components, such as beer or beer concentrates, and a carbonated liquid, if the composition of the mixture is precisely chosen and in reality composed as such.

Known beverage dispensers lack often the needed precision for mixing certain quantities and types of beverage components and carbonated liquid.

Furthermore, when a beverage dispenser is used for providing multiple different types of final beverages, each composed by mixing different quantities and types of beverage components, contamination of a mixture to be realized by remnants of a preceding mixture should be avoided, which is often not the case in the known beverage dispensers.

Certain beverage components are difficult to mix and require thoroughly mixing if a smooth, homogeneous mixture is to be obtained, which requires improved mixing means, and especially in such cases wherein direct contact with air should be avoided, as is often the case with foaming beverage components.

A factor that is also very important in some cases is the mixing time needed for realizing a good quality mixture of homogeneous structure.

In many cases, especially in beverage dispensers intended for dispensing a wide variety of different beverages it is preferred that the mixing of beverage components and carbonated liquid is realized almost instantaneously.

In that way it is avoided that beverage mixtures are kept during long time in certain containers and receptacles until their final use.

Again with the known beverage dispensers this cannot be realized for many combinations of beverage components, since the mixing means are not sufficiently efficient for mixing those beverage components.

It is therefore an objective of this invention to overcome one or more of the above-mentioned drawbacks or possibly other non-mentioned drawbacks of the known beverage dispensers.

In particular, it is an objective of the present invention to provide a beverage dispenser with improved mixing means, which allows for the mixing of beverage components which are not always easily mixed, such as foaming beverage components and this in a highly efficient, so to say instantaneously manner.

It is another objective of the present invention to provide a beverage dispenser with improved mixing means by which foaming of beverage components during the mixing can be controlled.

It is furthermore an objective of the present invention to provide a beverage dispenser in which many different beverage components and one or more carbonated liquids can be mixed into a wide variety of mixtures with a very high precision and without or with a much reduced contamination of the final beverage obtained.

To this aim, the invention proposes, a beverage dispenser which comprises:

a) at least one dispenser beverage inlet connected or connectable to a source of a beverage component;

b) at least one dispenser carbonated liquid inlet connected or connectable to a source of a carbonated liquid;

c) a mixing means for mixing one or more beverage components with at least one carbonated liquid into a final beverage; and, d) a dispenser outlet for dispensing the final beverage;

wherein said mixing means comprises one or more double jet mixers, comprising each at least a first jet mixer fluid supply entry and a second jet mixer fluid supply entry, a pair of corresponding coaxial jet mixer fluid flow channels having each a jet mixer discharge end for expelling fluids in mutually, oppositely directed or impinging jet streams, so to mix the fluids into a fluid mixture, and a jet mixer outlet through which the fluid mixture can leave the double jet mixer.

A big advantage of a beverage dispenser in accordance with the invention is that it comprises at least one double jet mixer.

In such an double jet mixer a very thorough mixing of the concerned beverage components with one another or with a carbonated liquid can be obtained in a very short time, while ensuring a high quality, i.e. homogeneity and smoothness, of the mixture.

Hereby, the mixing in the double jet mixer can take place in a very confined space and there is no need to expose the mixture to air or the like, which can be an important factor for avoiding premature foaming of the mixed beverage components or carbonated fluid.

On the other hand, by adapting the design or operational conditions of the double jet mixer it is also possible to use it on the contrary as a means for creating foam under controlled circumstances.

Such an adaptation of the design of the double jet mixer can for example be a change of the double jet mixer dimensions, such as the diameters of the jet mixer fluid flow cannels, the shape of the jet mixer discharge ends or the jet mixer outlet and so on.

Changing the nominal working point in the double jet mixer can usually be realized in a more dynamic way, for example by choking the fluid flow in the jet mixer fluid flow channels by means of a control valve and so on.

Also the angle between the directions in which the jet mixer discharge ends expel a liquid can be modified in order to change the characteristics of the double jet mixer.

In a preferred embodiment this angle can be 180° and the liquids are expelled in opposite directions so that the concerned double jet mixer is actually an opposed jet mixer.

In other embodiments this angle can deviate from 180° and the liquids expelled by the double jet mixer form impinging jet streams.

It is clear that such a beverage dispenser according to the invention opens a wide range of new possibilities, in particular for creating mixtures comprising one or more beers or beer concentrates.

The present invention also relates to an improved method for mixing one or more beverage components with at least one carbonated liquid.

Characteristic for the method according to the invention is that at least one double jet mixer as described above is used during the mixing and in that the method comprises at least the step of supplying a beverage component to the first jet mixer fluid supply entry and a beverage component or a carbonated liquid to the second jet mixer fluid supply.

According to a first preferred method in accordance with the invention a carbonated liquid is supplied to the second jet mixer fluid supply.

According to another preferred method in accordance with the invention however in a pre-mixing step beverage components are mixed by means of the double jet mixer into an intermediate mixture and in a final mixing step this intermediate mixture is mixed with a carbonated liquid.

The advantages of such a method are of course completely equivalent to the above-mentioned advantages described with respect to a beverage dispenser in accordance with the invention.

With the intention of better showing the characteristics of the invention, hereafter, as example without any limitative character, some embodiments of beverage dispensers according to the invention and methods according to the invention for mixing one or more beverage components with at least one carbonated liquid are described, with reference to the accompanying drawings, wherein.

Figure 5:
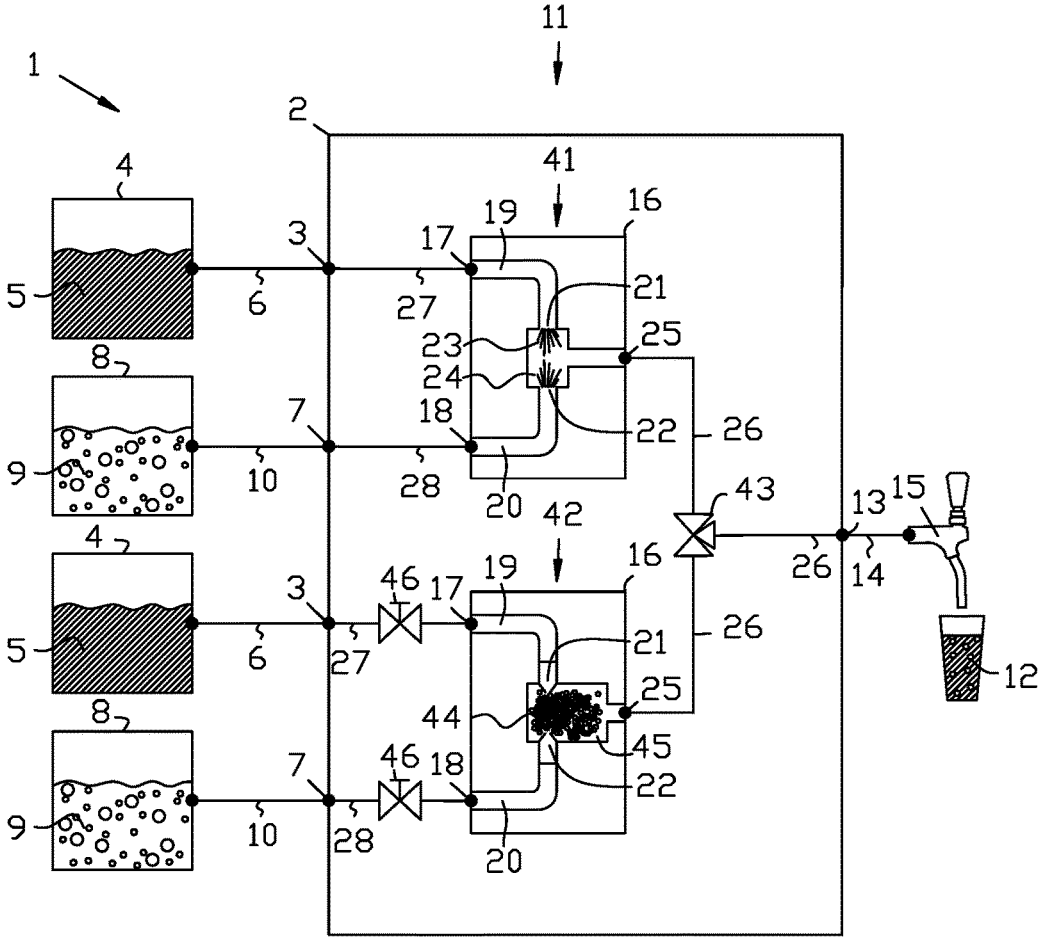
Figure 6:
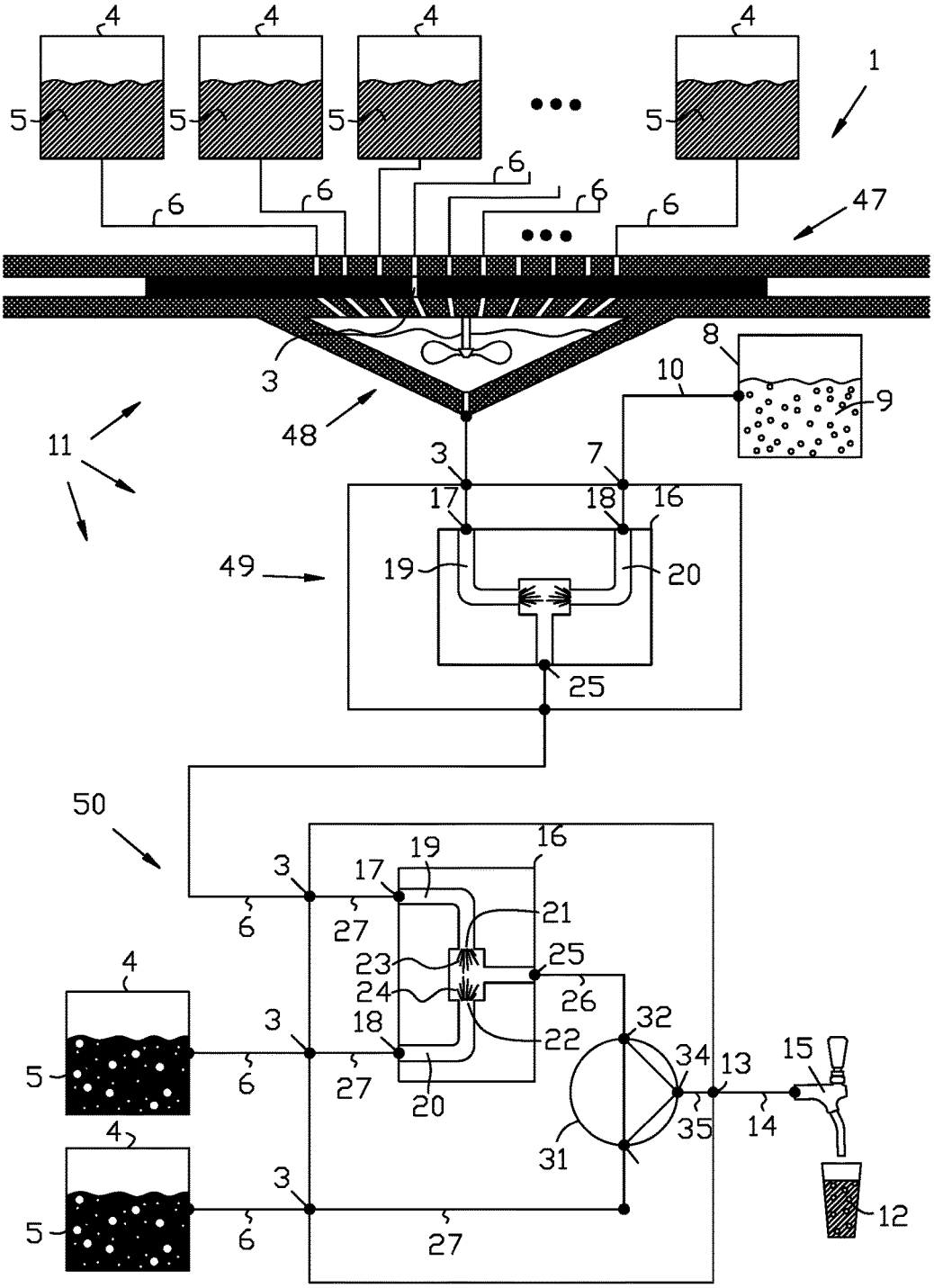

FIG. 5 is a schematic illustration of a fifth embodiment of a beverage dispenser in accordance with the present invention comprising two double jet mixers, a first for mixing beverage components into a substantially liquid phase and a second for creating a foam on the final beverage; and FIG. 6 is a schematic drawing of a sixth embodiment of a beverage dispenser in accordance with the present invention illustrating the mixing of multiple beverage components and carbonated liquids.

Figure 1:
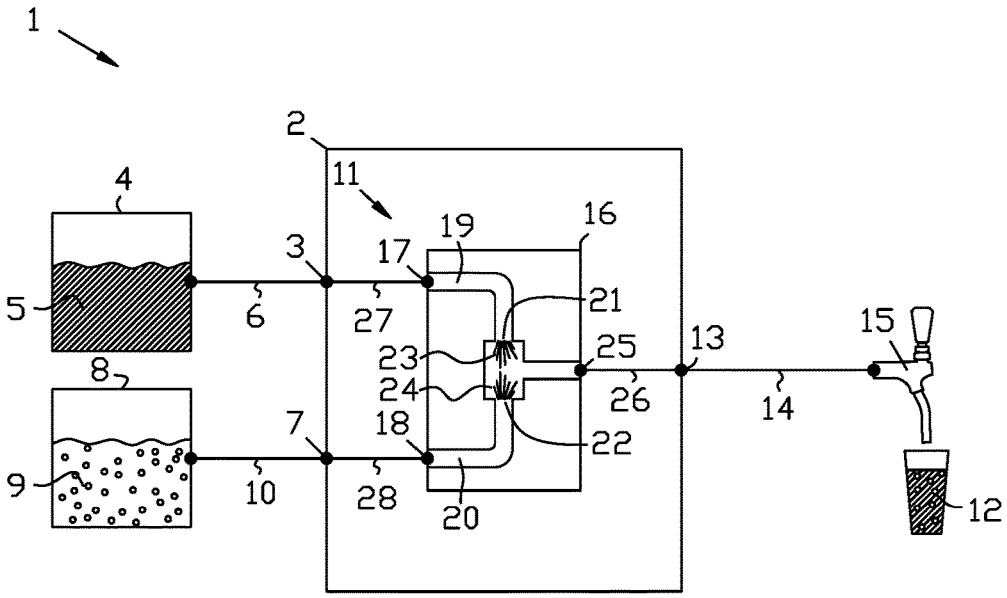
FIG. 1 is a schematic illustration of a first embodiment of a beverage dispenser in accordance with the present invention for mixing a beverage component and a carbonated liquid.

The first embodiment of a beverage dispenser 1 according to the invention, illustrated in FIG. 1, is schematically represented by a rectangular box 2, which box 2 could be in reality a real housing of the beverage dispenser 1, but this is not necessarily the case and the rectangular box 2 should rather be interpreted as a representation for a whole of elements which are likely to be present in a beverage dispenser 1 according to the invention, other obvious possible elements or details being omitted from the drawing.

The beverage dispenser 1 of FIG. 1 is provided with one dispenser beverage inlet 3 which is connected to a source 4 of a first liquid beverage component 5.

The dispenser beverage inlet 3 can for example be a pipe fitting which is suitable for connecting a source 4 to the beverage dispenser 1 or it can just be the inlet of a pipe or flexible tube used for flow of the liquid beverage component 5 away from the source 4.

The beverage component 5 can be any product that could be used for composing a beverage, such as for example a juice, a soft drink, a beer, a pasteurized beer, a beer concentrate, a strong alcohol, milk, cream, coffee, teaor even a diluent such as water and so on.

Depending on the type of the beverage component 5, the source 4 from which the beverage component 5 is supplied and in which the beverage component 5 is contained, can be for example a container, a plastic bag, a bottle, a keg or cask and so on.

The source 4 can be a pressurized vessel, containing a pressurized gas for driving the beverage component 5 out of the vessel.

In other cases the source 4 can comprise pumping means or separate gas bottles for that purpose, or the beverage component 5 can for example just leave the source 4 under the influence of gravity.

It is clear that all kinds of other commonly used elements, such as valves, switches, detectors, electronic or not electronic controller equipment in general are not represented in the drawings.

The source 4 is in this case connected to the inlet 3 by means of a liquid line 6, formed for example by a flexible or rigid tube or pipe 6.

The beverage dispenser 1 of FIG. 1 is furthermore provided with one dispenser carbonated liquid inlet 7, which is in this case connected to a source 8 of a carbonated liquid 9 by means of a liquid line 10.

The carbonated liquid 9 will typically be a diluent such as carbonated water, but it can be any other carbonated liquid, such as a soft drink or even a beer or the like, or it can even be a highly carbonated concentrate.

A carbonated liquid is a liquid in which carbon dioxide is dissolved.

Nevertheless, according to the invention, a large interpretation should be given to the term carbonated liquid 9.

This term covers also liquids wherein other gases such as nitrogen gas or nitrous oxide or a combination of several gases are dissolved, since liquids containing these gases have a behaviour which is from a technical point of view completely similar to a carbonated liquid, the fore-mentioned gases being also often used in practice.

The dispenser carbonated liquid inlet 7 and the source 8 can be of varying types similar to the dispenser beverage inlet 3 and the source 4, respectively.

The beverage dispenser 1 furthermore comprises a mixing means 11 for mixing the beverage component 5 with the carbonated liquid 9 into a final beverage 12.

This final beverage 12 is dispensed through a dispenser outlet 13, which can have different forms similar to the dispenser beverage inlet 3 or dispenser carbonated liquid inlet 7.

In the embodiment represented in FIGS. 1 to 6 the dispenser outlet 13 is connected by means of a liquid line 14 to a beer engine handle 15, by which the actual flow of final beverage 12 coming from the beverage dispenser is controlled.

The beverage dispenser 1 could for example be a box or casing provided in a bar in which the core of the mixing means 11 are housed, while the beer engine handle 15 is installed at some distance from that box on the bar and the sources 4 can be kegs provided in a cave, as is often the case in bars.

On the other hand, the sources 4 and 8, the dispenser inlets 3 and 7 and the dispenser outlet 13 can also be housed in a single housing, comparable to what is the case in many known beverage dispenser for dispensing for example coffee.

These examples are of course just a few of the many possibilities.

According to the invention the mixing means 11 comprise at least one double jet mixer 16, as is the case in the embodiment of FIG. 1.

The double jet mixer 16 comprises a first jet mixer fluid supply entry 17 and a second jet mixer fluid supply entry 18 as well as a pair of corresponding jet mixer fluid flow channels, respectively jet mixer fluid flow channel 19 and jet mixer fluid flow channel 20.

In the represented figures, these jet mixer fluid flow channels 19 and 20 are at least partly coaxial and have each a jet mixer discharge end, respectively jet mixer discharge end 21 and jet mixer discharge end 22, configured in such a way that fluids expelled from the jet mixer discharge ends 21 and 22 form mutually, oppositely directed jet streams 23 and 24 respectively.

In that way the jet streams 23 and 24 impinge on one another, so to mix the concerned fluids into a fluid mixture, an emulsion or foam.

In other embodiments the jet streams 23 and 24 are not necessarily directed in exactly opposite directions, but they could impinge on one another under another angle as well.

The double jet mixer 16 is furthermore provided with a jet mixer outlet 25 through which the fluid mixture, foam or emulsion can leave the double jet mixer 16.

The jet mixer outlet 25 is connected to the dispenser outlet 13 by means of a liquid line 26, but it could form directly the dispenser outlet 13 without intermediate liquid line 26.

In the embodiment of FIG. 1 the dispenser beverage inlet 3 is furthermore connected to the first jet mixer fluid supply entry 17 of the double jet mixer 16 by means of a liquid line 27, which can be formed by a separate tube or pipe or just by jet mixer fluid flow channel 19.

It is even not excluded that the liquid line 6 connecting the source 4 to the dispenser beverage inlet 3 and the liquid line 27 together with the jet mixer fluid flow channel 19 are all formed by a single tube or pipe.

In the embodiment of FIG. 1 the dispenser carbonated liquid inlet 7 is connected to the second jet mixer fluid supply entry 20 of the double jet mixer 16 by means of a liquid line 28, so to enable the mixing of the beverage component 5 and the carbonated liquid 9 by means of the double jet mixer 16.

The liquid line 28 can again be just a part of jet mixer fluid flow channel 20 and/or liquid line 14.

In FIG. 1 a case is represented wherein the beverage component 5 is a not carbonated beverage, such as a pasteurized beer concentrate, while the carbonated liquid 9 is of course carbonated, for example carbonated water.

Nevertheless, it is not excluded from the invention that beverage component 5 is carbonated as well, and is for example a carbonated beer concentrate which needs to be diluted for making it drinkable.

Figure 2:
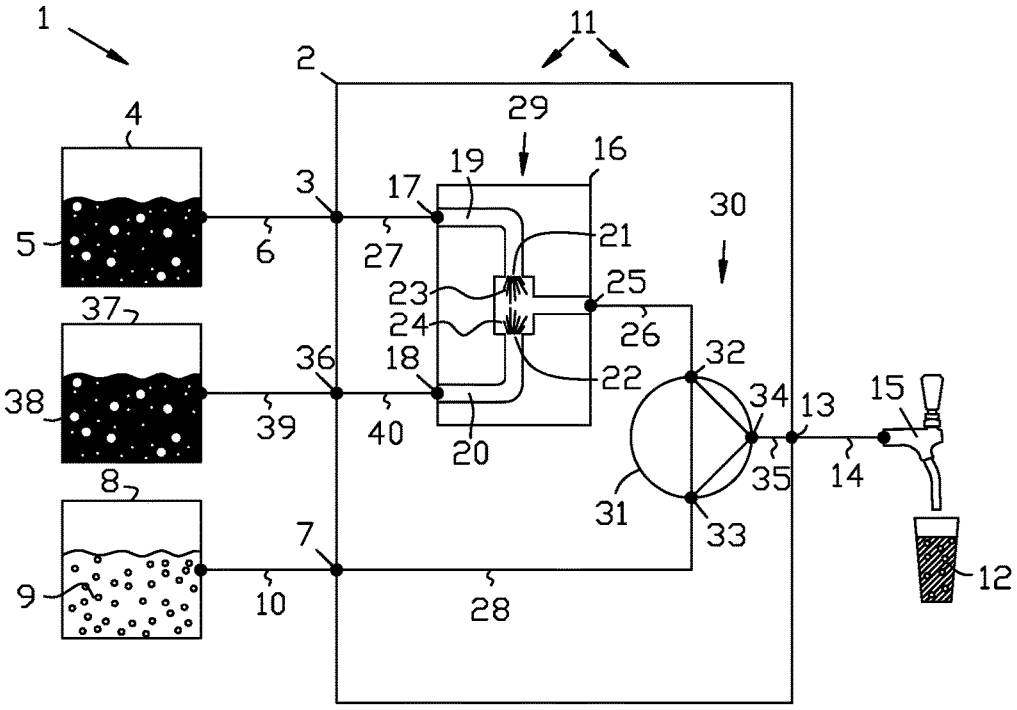
FIG. 2 is a schematic drawing of a second embodiment of a beverage dispenser in accordance with the present invention wherein an double jet mixer forms pre-mixing means for mixing beverage components into an intermediate mixture and wherein final mixing means provide in the mixing of the intermediate mixture with a carbonated liquid.

In FIG. 2 a second embodiment of a beverage dispenser according to the invention is illustrated, which comprises mixing means 11 which are somewhat different from the mixing means of the first embodiment.

In particular, the mixing means 11 comprise this time pre-mixing means 29 for mixing beverage components and/or a carbonated liquid into an intermediate mixture as well as a final mixing means 30 for mixing said intermediate mixture with one or more beverage components and/or a carbonated liquid into the final beverage 12.

In the embodiment of FIG. 2 a double jet mixer 16, similar to the one of FIG. 1, is forming the pre-mixing means 29 or is at least part of said pre-mixing means 29, while the final mixing means 30 comprise a receptacle 31 which might be provide with any auxiliary means by which the mixing fluid can be enhanced, the type of which being not further specified.

These auxiliary means can for example be formed by a blender or mixer, such as for example a classic electro-mechanical mixer having a blade which is rotated in the receptacle 31 containing the liquid to be mixed.

The receptacle has a first receptacle inlet 32 and a second receptacle inlet 33 for receiving liquids to be mixed, as well as a single receptacle outlet 34 for expelling the mixed liquids, which is symbolized in FIG. 2 by a triangular shape.

The receptacle outlet 34 is connected to the dispenser outlet 13 by means of a liquid line 35.

The liquid line 26 provided at the jet mixer outlet 25 of the double jet mixer 16 is therefore this time not connected to the dispenser outlet 13, but connected to the first receptacle inlet 32, so to guide fluid mixture mixed in the double jet mixer 16, which is forming the above-mentioned intermediate mixture, to the final mixing means 30.

In the embodiment of FIG. 2 carbonated liquid 9 is mixed with said intermediate mixture by means of the final mixing means 30, and as a consequence the dispenser carbonate liquid inlet 7 is this time connected to the second receptacle inlet 33 by means of liquid line 28.

In the second embodiment of FIG. 2, the dispenser beverage 1 comprises furthermore a first dispenser beverage inlet 3 and a second dispenser beverage inlet 36, each connected to a source of a beverage component, respectively to source 4 containing a first beverage component 5 by means of liquid line 6 and to source 37 containing a second beverage component 38 by liquid line 39.

The dispenser beverage inlet 3 is, as in the preceding case of FIG. 1, connected to the first jet mixer fluid supply entry 17 of the double jet mixer 16 by means of liquid line 27.

The second dispenser beverage inlet 36 is furthermore connected to the second jet mixer fluid supply entry 18 of the double jet mixer 16 by liquid line 40, so to enable the mixing of the first beverage component 5 and second beverage component 38 by means of the double jet mixer 16, after which the obtained intermediate mixture is mixed with carbonated liquid 9 by means of the final mixing means 31.

In FIG. 2 the beverage components 5 and 38 are represented as both being carbonated beverage components and those beverage components 5 and 38 could for example both be beer concentrates or a beer concentrate and a soft drink such as pepsi cola, which are mixed according to a desired ratio, to obtain the corresponding mixed flavour made of the flavours of both concerned beverage components.

As explained in the introduction, the double jet mixer 16 is very suitable, if correctly designed, for mixing such kinds of beverage components 5 and 38, without exposure of the mixture to air and in a very quick and efficient manner.

The obtained mixture of beer concentrates is mixed in the final mixing stage with a carbonated liquid 9, typically carbonated water, so to form an effervescent, sparkling and drinkable beer 12.

It is however not excluded from the invention to feed one or two not carbonated beverage components 5 and 38, such as beer concentrates or juices to the double jet mixer 16 in the pre-mixing stage.

It is also not excluded from the invention to add a not carbonated liquid in the second stage of the mixing process, for example not carbonated water, simply to change the concentration of the beverage components in the final beverage 12, which carbonated liquid thus serves as a diluent.

In still another embodiment the pre-mixing means 29 can also be intended for mixing a beverage component 5 with a carbonated liquid 9, as was also the case in the first embodiment, for example in order to recompose a first beer from its concentrate, after which the obtained intermediate mixture is further mixed with another beverage component by means of the final mixing means 30, for example with another beer so to form a final beer composed of a mixture of two beers.

Generally spoken, any carbonated liquid can be considered as being a carbonated liquid and the pre-mixing means 29 may comprise one or more fluid supply entries, each connected or connectable to a dispenser beverage inlet 3 or 36, or a dispenser carbonated liquid inlet 7.

In the example of FIG. 2 the pre-mixing means 29 comprise two fluid supply entries 17 and 18, which are each connected to a dispenser beverage inlet 3 and 36 respectively.

Similarly, the final mixing means 30 may in general comprise a first fluid supply entry 17 for supplying the intermediate mixture and one or more additional fluid supply entries, each connected or connectable to a dispenser beverage inlet 3 or 36 or a dispenser carbonated liquid entry 7.

In the example of FIG. 2, the final mixing means 30 comprise a first fluid supply entry 32 for supplying the intermediate mixture and a single second fluid supply 33 which is connected to one dispenser carbonated liquid inlet 9.

Figure 3:
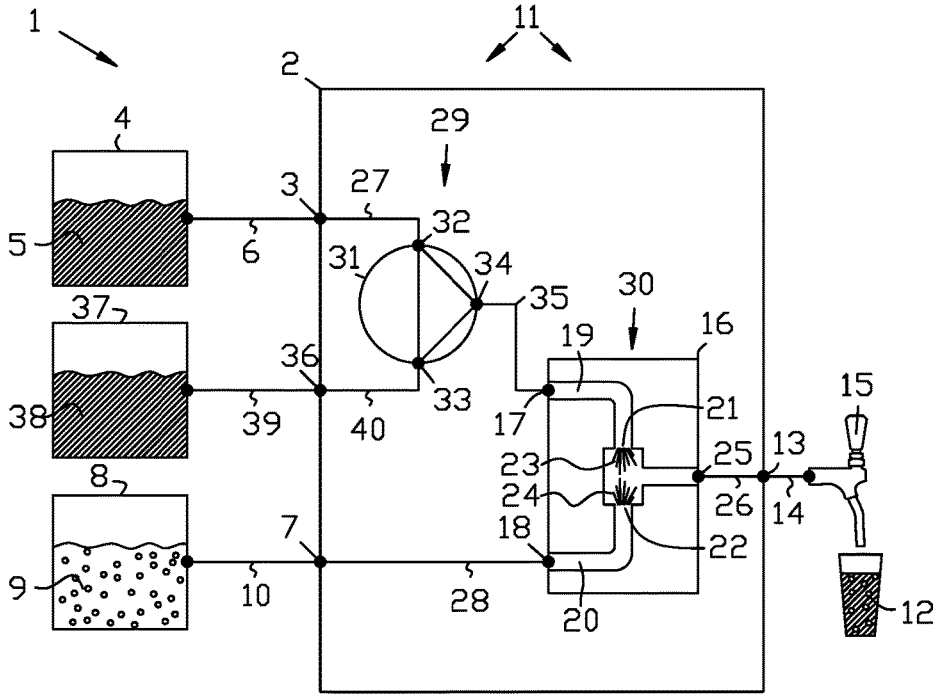
FIG. 3 is a schematic drawing of a third embodiment of a beverage dispenser in accordance with the present invention wherein pre-mixing means provide in the mixing of beverage components into an intermediate mixture and wherein a double jet mixer forms final mixing means for mixing of the intermediate mixture with a carbonated liquid.

FIG. 3 illustrates a third embodiment of a beverage dispenser in accordance with the invention.

This third embodiment is different from the second embodiment only in that the pre-mixing means 29 and the final mixing means 30 have been interchanged, i.e. double jet mixer 16 is this time forming the final mixing means 30 or is at least part of the final mixing stage 30, while the receptacle 31 is forming the pre-mixing means 29 or is at least part of it.

The represented example is the mixing of two none carbonated beverage components 5 and 38, which are mixed in the first pre-mixing stage 29 and which are diluted by means of a carbonated liquid 9 in the second final mixing stage 30

It is however clear that all kinds of other combinations of carbonated and none carbonated beverage components as well as liquids can be made according to the invention.

Figure 4:
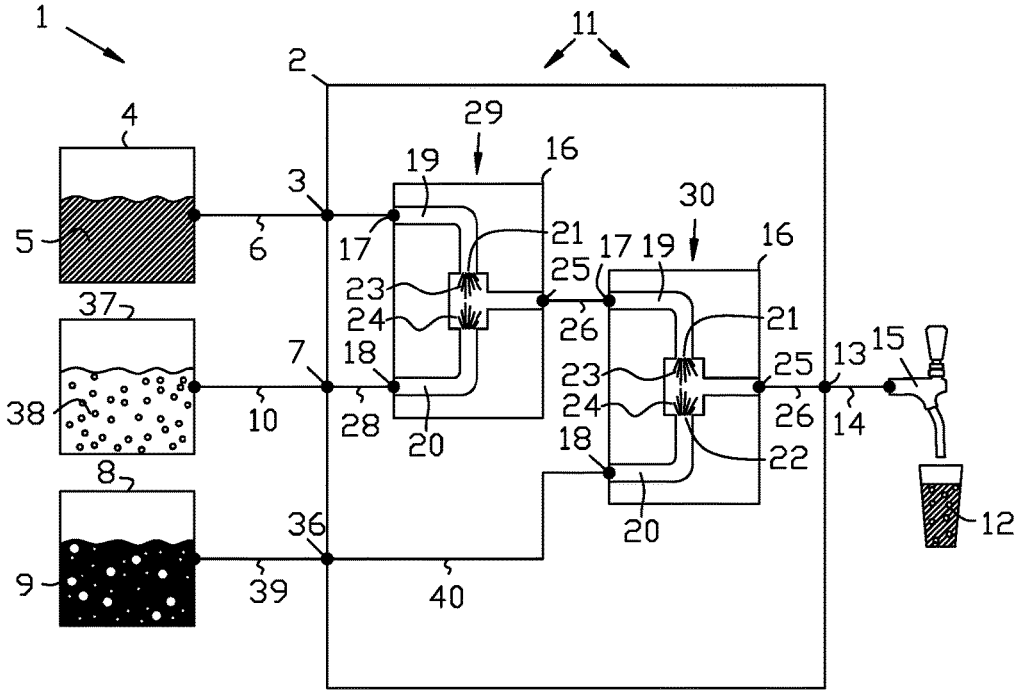
FIG. 4 is a schematic illustration of a fourth embodiment of a beverage dispenser in accordance with the present invention comprising two double jet mixers for mixing beverage components and a carbonated liquid.

FIG. 4 illustrates still another embodiment of a beverage dispenser 1 according to the invention, comprising again pre-mixing means 29 and final mixing means 30, which are this time both formed by a separate double jet mixer 16, the mixing means 11 of the beverage dispenser thus comprising multiple double jet mixers 16, i.e. in this case two but more are not excluded from the invention.

The example illustrated in FIG. 4 could be the dilution of a not carbonated beer concentrate 5 with carbonated liquid 9 in the first step, after which the obtained beer, i.e. intermediate mixture, is further mixed with another beer 9 in the second step to form the final beverage 12.

The fifth embodiment of a beverage dispenser 1 illustrated in FIG. 5 is somewhat similar with the fourth embodiment of FIG. 4 in that its mixing means 11 comprises again two double jet mixers 16.

In the fifth embodiment, the mixing means can also be divided in two mixing means parts 41 and 42, each formed by one of the double jet mixers 16, these mixing means parts 41 and 42 being however somewhat different in that they can work in parallel, i.e. the first mixing means part 41 is not supplying an intermediate mixture to one of the jet mixer fluid supply entries 17 and 18 of the double jet mixer of the second mixing means part 42.

Instead, both jet mixer outlets 25 are connected to the dispenser outlet 13 by means of a T-shaped liquid line 26, in which a 3-way valve 43 is provided for choosing which of both jet mixer outlets 25 can actually provide a mixture to the dispenser outlet 13.

Another aspect of this fifth embodiment is that the double jet mixer 16 of the second mixer means part 42 is of another kind, i.e. intended for producing foam 44 during the mixing of the concerned beverage component 5 and/or carbonated liquid 9 and this in a controlled way.

The double jet mixer 16 of this mixer means part 42 is therefore designed differently, which is illustrated in FIG. 5 by means of adapted discharge ends 21 and 22, which have a different shape stimulating foam forming, by means of a foam forming chamber 45 providing sufficient space and air for the expansion of foam 44 and by means of valves 46 provided in the liquid lines 27 and 28 at the jet mixer fluid supply entries 17 and 18 for choking the fluid flow through the jet mixer fluid flow channels 19 and 20.

Of course, FIG. 5 illustrates just schematically some parameters which could be changed in order to adapt a double jet mixer 16 into a foam producing means.

In reality, depending on the liquids to be mixed and foamed completely different parameters can come into play and should be tested.

Finally, FIG. 6 illustrates still another embodiment of a beverage dispenser according to the invention some principles explained by means of the preceding embodiments are combined.

A special aspect of this sixth embodiment is that the beverage dispenser 1 is provided with an inlet 3 which is connectable to different sources 4 each containing a different beverage component 5.

In particular, the inlet 3 can slide in a beverage component selector 47 for being connected with a source 4 of choice.

In that way different beverage components 5, for example pasteurized beer concentrates, can be supplied to a receptacle of a first mixing stage 48 provided with appropriate mixing means, which will not be described further in detail.

The first intermediate mixture obtained be mixing the different beverage components in first mixing stage 48 are supplied to a second mixing stage 49, comparable to the beverage dispenser 1 illustrated in FIG. 1, comprising a first double jet mixer 16 for mixing the first intermediate mixture with a carbonated liquid 9, so to form a second intermediate mixture.

Finally, the second intermediate mixture is mixed in a third mixing stage, which is similar to the beverage dispenser 1 illustrated in FIG. 2, with different other beverage components 5 so to form the final beverage 12.

It is clear that many other configurations are possible according to the invention and that also all kinds of controlling means can be added, for example in order to allow a user of selecting certain beverage components 5 in certain quantities and so on.

The present invention is by no means limited to a beverage dispenser 1 according to the invention and a method according to the invention for mixing one or more beverage components 5 with at least one carbonated liquid 9, described as examples and illustrated in the drawings, but such a beverage dispenser 1 and such a method according to the invention can be realised in all kinds of variants, without departing from the scope of the invention.

The invention claimed is:

1. A beverage dispenser comprising:

at least one dispenser beverage inlet connected or connectable to a source of a beverage component;

at least one dispenser carbonated liquid inlet connected or connectable to a source of a carbonated liquid;

a mixing device for mixing one or more beverage components with at least one carbonated liquid into a final beverage; and a dispenser outlet for dispensing the final beverage;

wherein said mixing device having one or more double jet mixers, each one or more double jet mixer having at least a first jet mixer fluid supply entry and a second jet mixer fluid supply entry, a pair of corresponding jet mixer fluid flow channels having each a jet mixer discharge end for expelling fluids in mutually, oppositely directed or impinging jet streams, so to mix the fluids into a fluid mixture, foam or emulsion, and a jet mixer outlet through which the fluid mixture, foam or emulsion can leave the double jet mixer before proceeding to the dispenser outlet.

2. The beverage dispenser according to claim 1, wherein the at least one dispenser beverage inlet is connected or connectable to the first jet mixer fluid supply entry of a first double jet mixer.

3. The beverage dispenser according to claim 2, further comprising a second dispenser beverage inlet connected or connectable, on the one hand, to a source of a second beverage component, and, on the other hand, to the second jet mixer fluid supply entry of the first double jet mixer, so to enable the mixing of the first and second beverage components by the first double jet mixer.

4. The beverage dispenser according to claim 2, wherein the at least one dispenser carbonated liquid inlet is connected or connectable to the second jet mixer fluid supply entry of the first double jet mixer, so to enable the mixing of the first beverage component and the carbonated liquid by the first double jet mixer.

5. The beverage dispenser according to claim 1, further comprising a second dispenser beverage inlet connected or connectable, on the one hand, to a source of a second beverage component, and, on the other hand, to the second jet mixer fluid supply entry of the first double jet mixer, so to enable the mixing of the first and second beverage components by the first double jet mixer.

6. The beverage dispenser according to claim 1, wherein the at least one dispenser carbonated liquid inlet is connected or connectable to the second jet mixer fluid supply entry of the first double jet mixer, so to enable the mixing of the first beverage component and the carbonated liquid by the first double jet mixer.

7. The beverage dispenser according to claim 1, wherein the dispenser beverage inlets are each connected or connectable to a source of a corresponding beverage component, which is not carbonated.

8. The beverage dispenser according to claim 1, wherein the mixing device comprises pre-mixing device for mixing beverage components and/or a carbonated liquid into an intermediate mixture and a final mixing device for mixing said intermediate mixture with one or more beverage components and/or a carbonated liquid into the final beverage.

9. The beverage dispenser according to claim 8, wherein the pre-mixing device comprises one or more fluid supply entries each connected or connectable to a dispenser beverage inlet or a dispenser carbonated liquid inlet.

10. The beverage dispenser according to claim 8, wherein the pre-mixing device comprises one or more fluid supply entries each connected or connectable to a dispenser beverage inlet.

11. The beverage dispenser according to claim 8, wherein the final mixing device comprises a first fluid supply entry for supplying the intermediate mixture and one or more additional fluid supply entries, each connected or connectable to a dispenser beverage inlet.

12. The beverage dispenser according to claim 8, the final mixing means device comprises a first fluid supply entry for supplying the intermediate mixture and a single second fluid supply which is connected or connectable the at least one dispenser carbonated liquid inlet.

13. The beverage dispenser according to claim 8, wherein a double jet mixer forms the pre-mixing device or is part of the pre-mixing device.

14. The beverage dispenser according to claim 8, wherein a double jet mixer forms the final mixing device or is part of the final mixing device.

15. The beverage dispenser according to claim 1, wherein air contact with the fluid mixture, foam, or emulsion is prevented until dispensing from the dispenser outlet.

16. The beverage dispenser according to claim 1, comprising:

a liquid line connecting the jet mixer outlet to the dispenser outlet, the dispenser outlet disposed downstream from the jet mixer outlet and configured to dispense the fluid mixture, foam, or emulsion.

17. A method for mixing one or more beverage components with at least one carbonated liquid, wherein at least one double jet mixer is used during the mixing, having at least a first jet mixer fluid supply entry and a second jet mixer fluid supply entry, a pair of corresponding coaxial jet mixer fluid flow channels having each a jet mixer discharge end for expelling fluids in mutually, oppositely directed jet streams so to mix the fluids into a fluid mixture, and a jet mixer outlet through which the fluid mixture can leave the double jet mixer, and in that the method comprises at least the step of supplying a beverage component to the first jet mixer fluid supply entry and a beverage component or a carbonated liquid to the second jet mixer fluid supply.

18. The method according to claim 17, the method further comprising a pre-mixing step wherein beverage components are mixed by the double jet mixer into an intermediate mixture and a final mixing step wherein the intermediate mixture is mixed with a carbonated liquid.

19. The method according to claim 18, wherein a carbonated liquid is supplied to the second jet mixer fluid supply.

* * * * *